US005127797A

United States Patent [19]

Carman

[11] Patent Number: 5,127,797

[45] Date of Patent: Jul. 7, 1992

[54] COMPRESSOR CASE ATTACHMENT MEANS

[75] Inventor: Kenneth E. Carman, Palm Beach Gardens, Fla.

[73] Assignee: United Technologies Corporation, Hartford, Conn.

[21] Appl. No.: 581,240

[22] Filed: Sep. 12, 1990

[51] Int. Cl.[5] ..... F04D 29/54

[52] U.S. Cl. ..... 415/209.2

[58] Field of Search ..... 415/115, 116, 209.1-209.3, 415/134-139, 173.1, 173.3, 12

[56] References Cited

U.S. PATENT DOCUMENTS 2,962,256 11/1960 Bishop ..... 415/12
3,860,358 1/1975 Cavicchi et al. ..... 415/173.3
3,892,497 7/1975 Gunderlock et al. ..... 415/134
3,966,356 6/1976 Irwin ..... 415/173.3
4,101,242 7/1978 Coplin et al. ..... 415/134
4,529,355 7/1985 Wilkinson ..... 415/173.1
4,566,851 1/1986 Comeau et al. ..... 415/115
4,752,184 6/1988 Liang ..... 415/173.3
4,804,310 2/1989 Fuller et al. ..... 415/115

*Primary Examiner*—John T. Kwon
*Attorney, Agent, or Firm*—Norman Friedland

[57] ABSTRACT

A segmented stator vane of a compressor in a gas turbine engine is supported to a full hoop outer case by a "tongue and groove" removable support element that provides radial and tangential restraint while permitting each of the segments to grow thermally in the axial and circumferential directions.

5 Claims, 7 Drawing Sheets

COMPRESSOR CASE ATTACHMENT MEANS

CROSS REFERENCE

The subject matter of this application is related to the subject matter of the following commonly assigned patent applications: U.S. application Ser. No. 581223 entitled "Fastener For Multi-Stage Compressor"; U.S. application Ser. No. 581,224 entitled "Fastener Mounting For Multi-Stage Compressor"; U.S. application Ser. No. 581,231 entitled "Case Tying Means For A Gas Turbine Engine"; U.S. application Ser. No. 581,230 entitled "Compressor Bleed"; U.S. application Ser. No. 581,229 entitled "Segmented Stator Vane Seal"; U.S. application Ser. No. 581,228 entitled "Backbone Support Structure For Compressor"; U.S. application Ser. No. 581,227 entitled "Compressor Case Construction With Backbone"; U.S. application Ser. No. 581,219 entitled "Compressor Case Construction"; U.S. application Ser. No. 581,220 entitled "Compressor Case With Controlled Thermal Environment"; all of the above filed on even date herewith.

TECHNICAL FIELD

This invention relates to the compressor section of gas turbine engines and more particularly to the stator support means.

BACKGROUND ART

As is well known, the compressor case of a gas turbine engine powering aircraft is subjected to severe pressure and temperature loadings throughout the engine operating envelope and care must be taken to assure that the components remain concentric maintaining relatively close running clearances so as to avoid inadvertent rubs. Inasmuch as the engine case is thin relative to the rotor and stator components in the compressor section, it responds more rapidly to temperature changes than do other components. This is particularly true during periods of transient engine performance. Typical of these transients are throttle chops, throttle bursts, and the like. Obviously it is customary to provide sufficient clearances during these transients to assure that the rotating parts do not interfere with the stationary parts.

The problem becomes even more aggravated when the engine case is fabricated in two halves (split case) which is necessitated for certain maintenance and construction reasons. Typically, the halves are joined at flanges by a series of bolts and the flanges compared to the remaining portion of the circumference of the case is relatively thick and hence does not respond to thermal and pressure changes as quickly as the thinner portion of the case. The consequence of this type of construction is that the case has a tendency to grow eccentrically or out of round.

In certain instances in order to attain adequate roundness and concentricity to achieve desired clearance between the rotating and non-rotating parts, it was necessary to utilize a full hoop case for the highest stages of a multiple stage compressor. Since the stator components, i.e., stator vanes and outer air seals, are segmented the problem was to assure that the compressor maintained its surge margin notwithstanding the fact that the outer case would undergo large deflection at acceleration and deceleration modes of operation. The cavity that exists between the outer case and the inner case formed by the segmented stator components, being subjected to pressures occasioned by the flow of engine air through the various leakage paths, presented a unique problem. In the event of a surge, which is a non-designed condition, the pressure in the gas path would be reduced significantly. Because the air in the cavity is captured and cannot be immediately relieved, it would create an enormous pressure difference across the stator components, cause them to distort, with a consequential rubbing of the compressor blades, and a possible breakage.

In order to withstand this pressure loading and yet achieve the roundness and clearance control of the stationary and rotating components it was necessary to incorporate a mechanism that would tie the outer case to the segmented stator components. While it became important to assure that this rubbing did not occur, particularly where severe rubbing could permanently damage the blades and/or rotor/stator during surge, the mechanism that is utilized must be capable of withstanding this enormous load, yet be insensitive to fatigue.

Moreover, in order to achieve roundness and maintain close tolerance between the tips of the blades and outer air seal it is abundantly important that the components subjected to high thermal and load differentials do not allow the outer and inner cases to grow eccentrically. To this end the aft end of the stator is supported by a bulkhead or a back bone that is formed from a relatively straight shaped annular support that is attached to the inner segmented case and the outer case. The bulkhead or backbone is attached in such a way that the inner case floats axially and circumferentially while being restrained radially. While this arrangement enhances the control of the clearances between the tips of the blades and outer air seal, it is only a portion of the support necessary for the stator.

While the design of the aft end of the engine case support structure as described above provides axial and circumferential freedom, it is also necessary to provide other means to allow axial and circumferential movement at the forward end of the stator structure that is supported by the full hoop engine case. In accordance with this invention, I have provided a "tongue and groove" arrangement that provides the radial restraint and allows each segment to grow thermally in the axial and circumferential direction.

This configuration also facilitates the assembly and disassembly of the full hoop case over a segmented stator and drum rotor.

Additionally and in accordance with this invention means integral with the support structure are provided for assuring the segments do not rotate within the full hoop case.

STATEMENT OF THE INVENTION

An object of this invention is to provide an improved structural support for a portion of the stators of the high pressure compressor of a gas turbine engine.

A feature of this invention is to provide for a compressor drum rotor means for supporting the stator to the full hoop compressor case that permits axial displacement and circumferential thermal growth of the stator segment while providing radial support and positioning.

Another feature of this invention is to provide a centrally oriented "tongue and groove" fit which provides tangential support to stator segment pressure loads.

A still further feature of this invention is the use of an integral groove in a full hoop case to react the loads applied to the centrally located support segment.

A still further feature of this invention is the use of support segments with radially oriented "tongue and groove" fit which allows the assembly and disassembly of a full hoop case over a segmented stator and drum rotor.

A still further feature of this invention is the use of an integral groove in a full hoop case to anti-rotate the support segment and preclude bolts from loosening.

The foregoing and other features and advantages of the present invention will become more apparent from the following description and accompanying drawings.

BEST MODE FOR CARRYING OUT THE INVENTION

Figure 1:
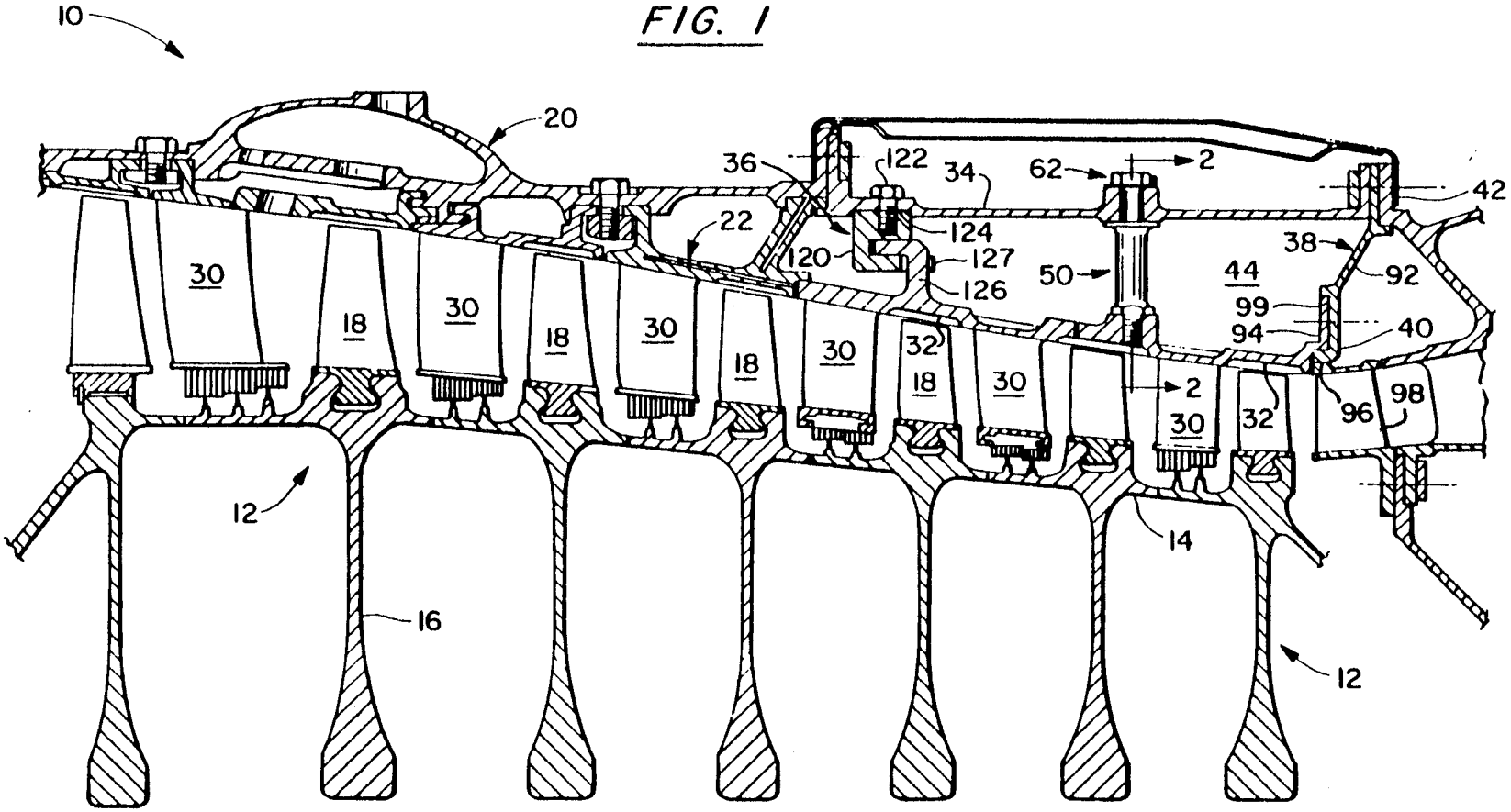
FIG. 1 is a partial view partly in section and partly in elevation of a multi-stage axial flow compressor for a gas turbine engine.
Figure 2:
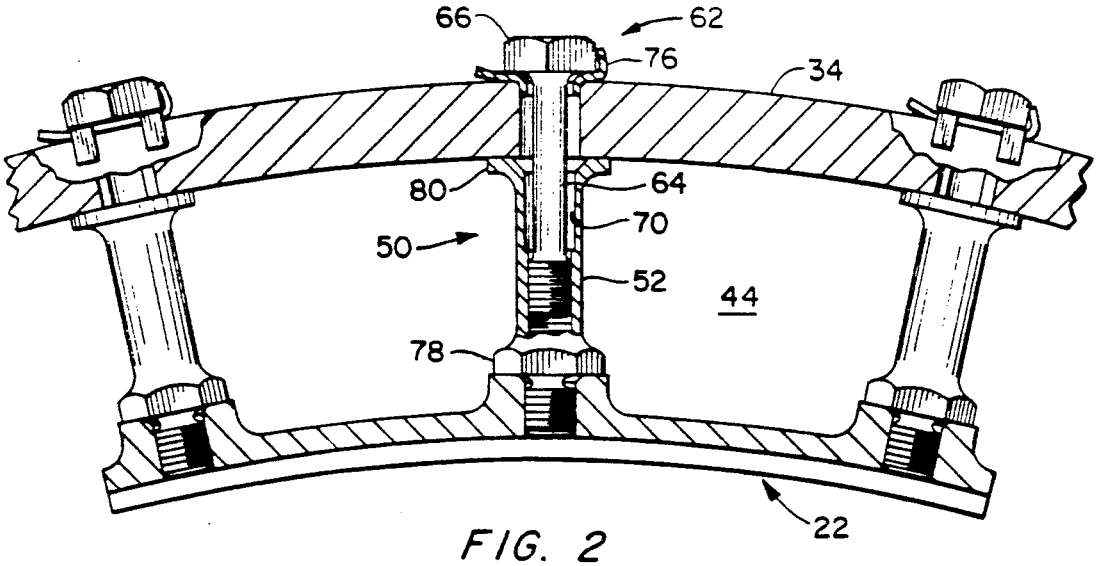
FIG. 2 is a partial sectional view partly in schematic taken along lines 2—2 of FIG. 1 showing one of several segments of the components making up the inner case.
Figure 3:
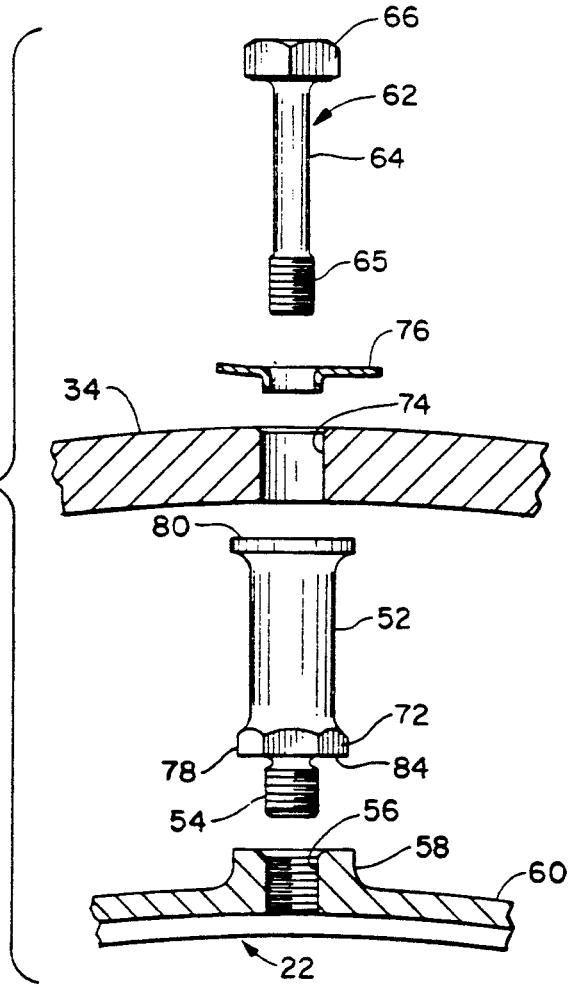
FIG. 3 is an exploded view of the spool/bolt element.
Figure 4:
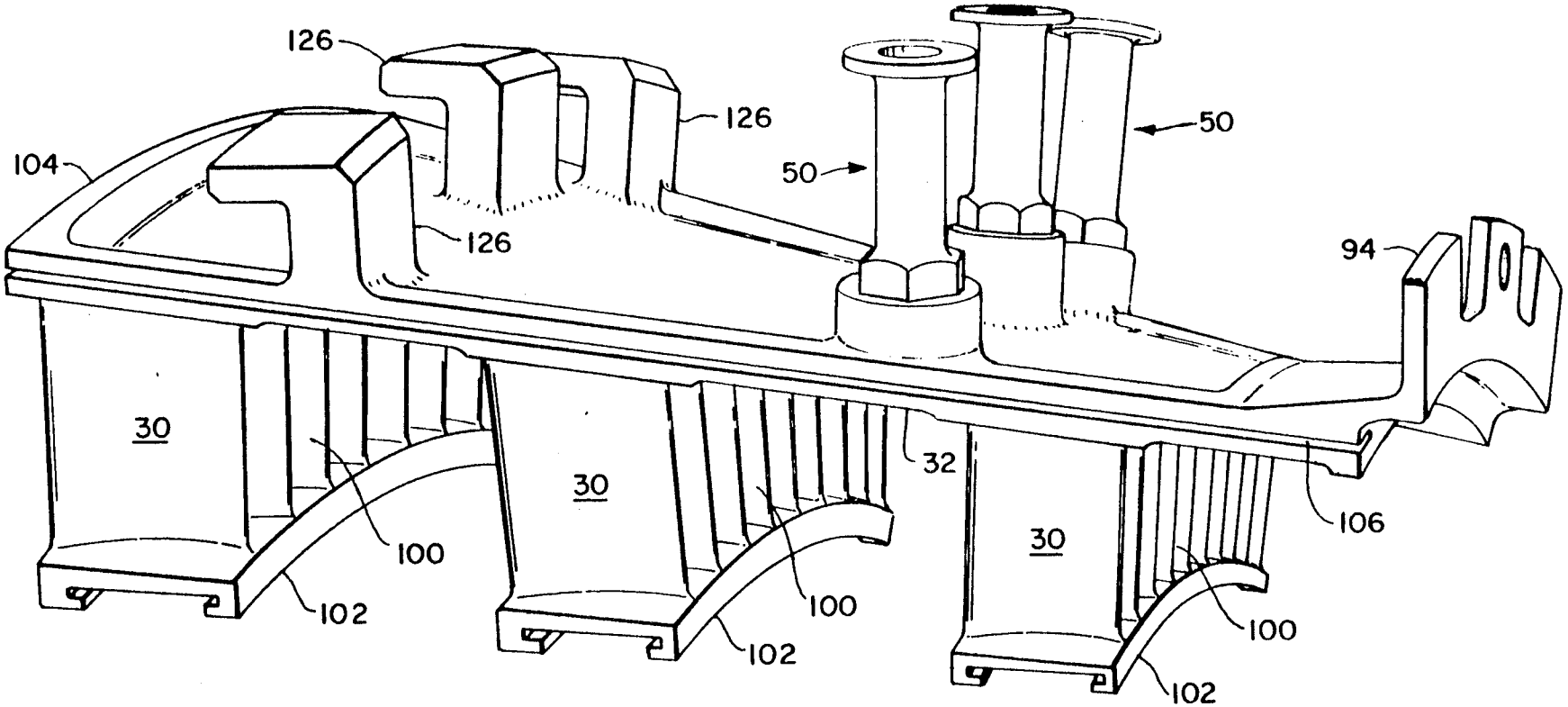
FIG. 4 is a perspective view showing the details of a segment of the stator vane.

To best understand this invention reference is made to FIGS. 1–6 showing part of a multi-stage compressor for a gas turbine engine of the type for powering aircraft. For more details of a gas turbine engine the F100 family of engines manufactured by Pratt & Whitney, a division of United Technologies Corporation, the assignee of this patent application, is incorporated herein by reference. Suffice it to say that in the preferred embodiment the engine on which this invention is being utilized is a fan-jet axial flow compressor multi-spool type. As noted in FIG. 1 the compressor section generally indicated by reference numeral 10 is comprised of a plurality of compressor rotors 12 retained in drum rotor 14, where each rotor includes a disk 16 supporting a plurality of circumferentially spaced compressor blades 18. The rotors 12 are suitably supported in an outer engine case 20 and an inner case 22.

In this configuration a portion of the outer case 20 is fabricated in two axial circumferential halves and the other portion is fabricated in a full hoop generally cylindrically shaped case. In FIG. 1 the first four lower pressure stages as viewed from the left hand side are housed in the split case and the last three stages are housed in the full case.

Inasmuch as this invention pertains to the aft section (full case) of the compressor, for the sake of simplicity and convenience only the portion of the compressor dealing with the full case will be discussed hereinbelow. The inner case 22 which comprises the stator vanes 30 and outer air seal 32 are supported in the full case 34 via the dog-jaw hook connection 36 and the bulkhead 38 which carries suitable attaching flanges 40 and 42.

As was mentioned above the problem associated with this construction is that the cavity 44 between the inner case 22 and outer case 34 is ultimately pressurized by the fluid leaking therein from the engine flow path. The engine flow path is defined by the annular passageway bounded by the inner surface of the inner case 22 and outer surface of drum rotor 14. This pressure can reach levels of 5-600 pounds per square inch (PSI). Should a surge situation occur the pressure level in the gas path can reduce instantaneously to a value much lower than the 5-600 PSI and since the pressure in cavity 44 is trapped and can only be reduced gradually, an enormous pressure differential exists across inner case 22.

The spool/bolt arrangement generally illustrated by reference numeral 50 ties the inner case 22 to outer case 34 in such a manner as to enhance fatigue life and provide sufficient strength to withstand the compressor surge problems. Spool/bolt 50 comprises a spool member 52 having a reduced diameter threaded portion 54 at its lower extremity adapted to be threaded onto the complementary internal threads 56 formed in boss 58 extending radially from the outer surface 60 of inner case 22.

The bolt 62 comprises a relatively long shank 64 carrying threads 65 at the lower extremity and a significantly large head 66. Head 66 may be hexagonally shaped and is thicker and has a longer diameter than otherwise would be designed for this particular sized shank. These unusual dimensions of the head serve to reduce the stress concentration and increase fatigue life of the head to shank fillet adjacent the head.

The bolt 62 fits into bore 70 centrally formed in spool 52 that extends just short of the remote end of the entrance to the bore. The inner diameter of bore 70 is threaded to accommodate the threaded portion of bolt 62. The spool 52 carries a tool receiving portion 72 for threadably securing the spool to inner case 22.

In the assembled condition, the spool 52 is threaded to inner case 22 and the bolt 62 passing through opening 74 in the outer case 34 is threaded to the inner threads of the spool 52, until the head bears against the outer surface of outer case 34 or a suitable washer. Tab washer 76 may be employed to prevent the bolt from inadvertently retracting.

After the spool is torqued sufficiently to urge end face portion 78 to bear against inner case 22, the bolt 62 is sufficiently torqued so that the flange-like portion 80 bears against the surface of outer case 34. The amount of torque will depend on the particular application but it should be sufficient to keep spool 52 in compression throughout the operating range of the engine.

As is apparent from the foregoing, the spool serves as a compressed flange-like member thus reducing both bolt fatigue and surge stresses. This configuration resists fatigue loads occasioned by thermal axial deflection differences between outer case 34 and the segmented inner case 22.

The thread sizes of threads 65 of bolt 62 and threads 54 of spool 52 are different (the threads 54 are specifically designed to be larger). Because the diameter of the spool threads 54 are larger it has a higher disassembly breakaway torque than bolt 62. Consequently, the bolt will, by design, loosen first.

The bulkhead 38 or backbone is a load carry member and is generally annularly shaped forming a relatively straight piece but having a radially extending lower portion 40, an angularly extending middle portion 92 and another radially extending upper portion 42. As mentioned earlier the extremities, i.e. the lower and upper portions 40 and 42 serve basically as flanges and are adapted to be bolted to the inner and upper cases 22 and 20, respectively. The forward face of the lower portion 40 is recessed 99 to accept the radially extending flange 94 integrally formed on the rear end of the inner segmented case 22, forming a somewhat tongue-in-groove arrangement. The inner diameter 96 of bulkhead 38 is dimensioned so that it snugly fits onto the upper surface of the next adjacent stator vane assembly 98 which serves to reduce scrubbing of the case tied assembly, just described.

As described above, the stator vane 30 are cast into unitary segments that when mounted end-to-end in the circumferential direction forms three (3) rows of vanes. The stator vane comprises circumferentially spaced airfoil sections 100 and an inner shroud 102 and an outer shroud 104, the outer shroud defining the inner case. As viewed from the perspective drawing of FIG. 4, the three rows of vanes are unitary with the outer shroud 104 and each segment abuts the adjacent segment.

In accordance with this invention, a plurality of circumferentially spaced removable support segments 120 are bolted by bolts 122 to fit into the recess or groove 124 formed on the inner diameter of the full hoop case 34. A complementary number of hooks 126 (see FIG. 4) are likewise spaced circumferentially around the stator vane segments and extend radially to form a radial "tongue and groove" fit. As is apparent from the foregoing, the "tongue and groove" or dog-jaw serve to tie the stator vane or inner case to the outer case and restrain the radial movement of the case.

Figure 7:
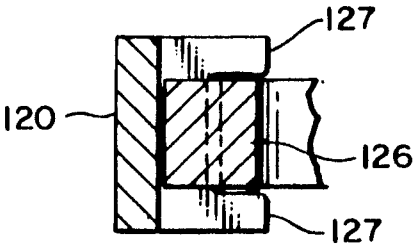
FIG. 7 is a sectional view taken along lines 7—7 of FIG. 5B.

To provide tangential restraint to the stator, a plurality of lugs 127 are carried at the end of the centrally located segments 12O which are bifurcated to sandwich the stator hook 126. This can best be seen by referring to FIG. 6 and FIG. 7 which is a section view taken along lines 7—7 of FIG. 5B.

The support segments 120 are made removable so that the full hoop case 34 can be assembled or disassembled by sliding over the drum rotor/stator vane assembly. The method of assembly and disassembly is depicted by FIGS. 5, 5A and 5B.

Figure 5:
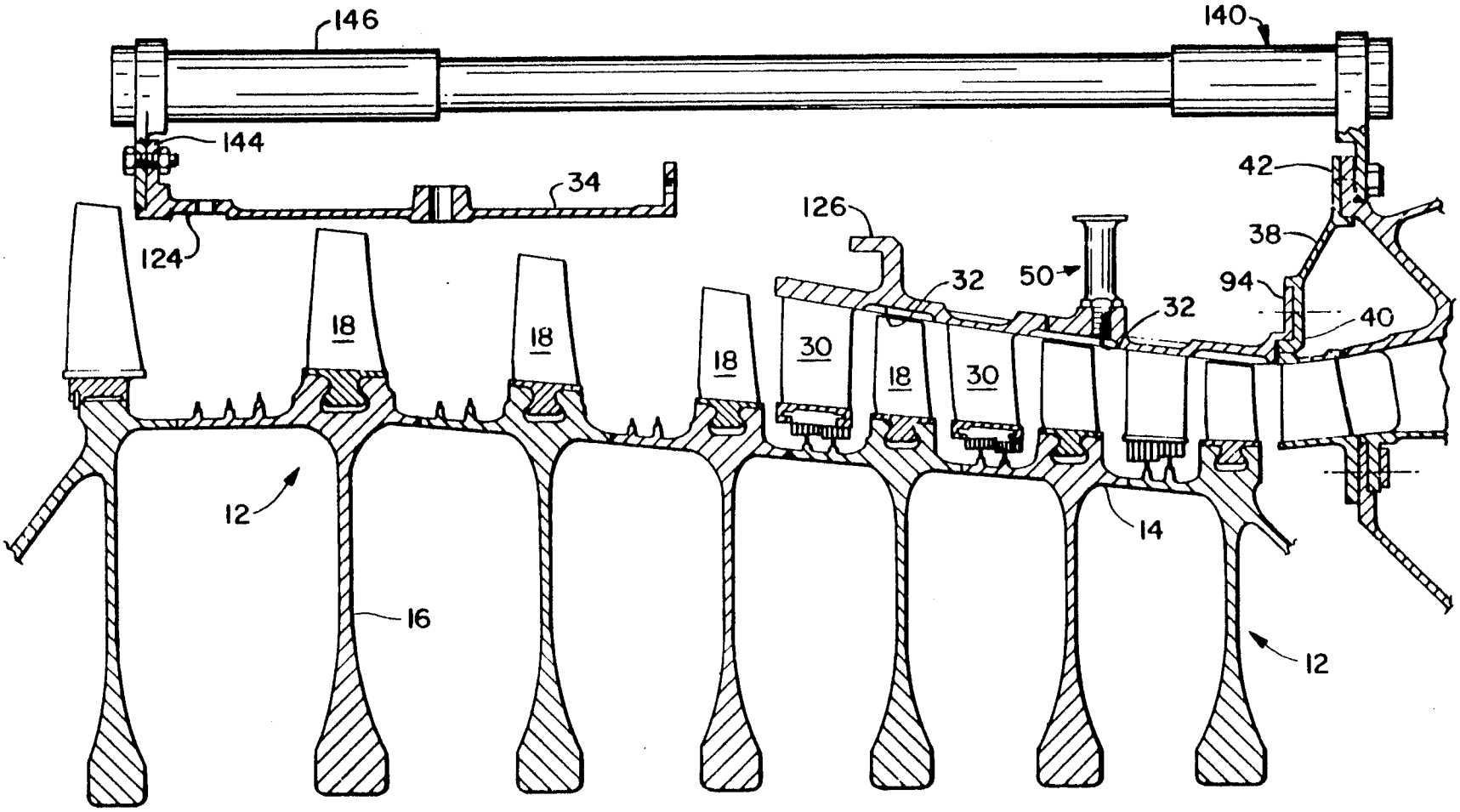
FIG. 5 is a partial view partly in section and partly in elevation showing the method of assembly of a portion of compressor section.
Figure 5A:
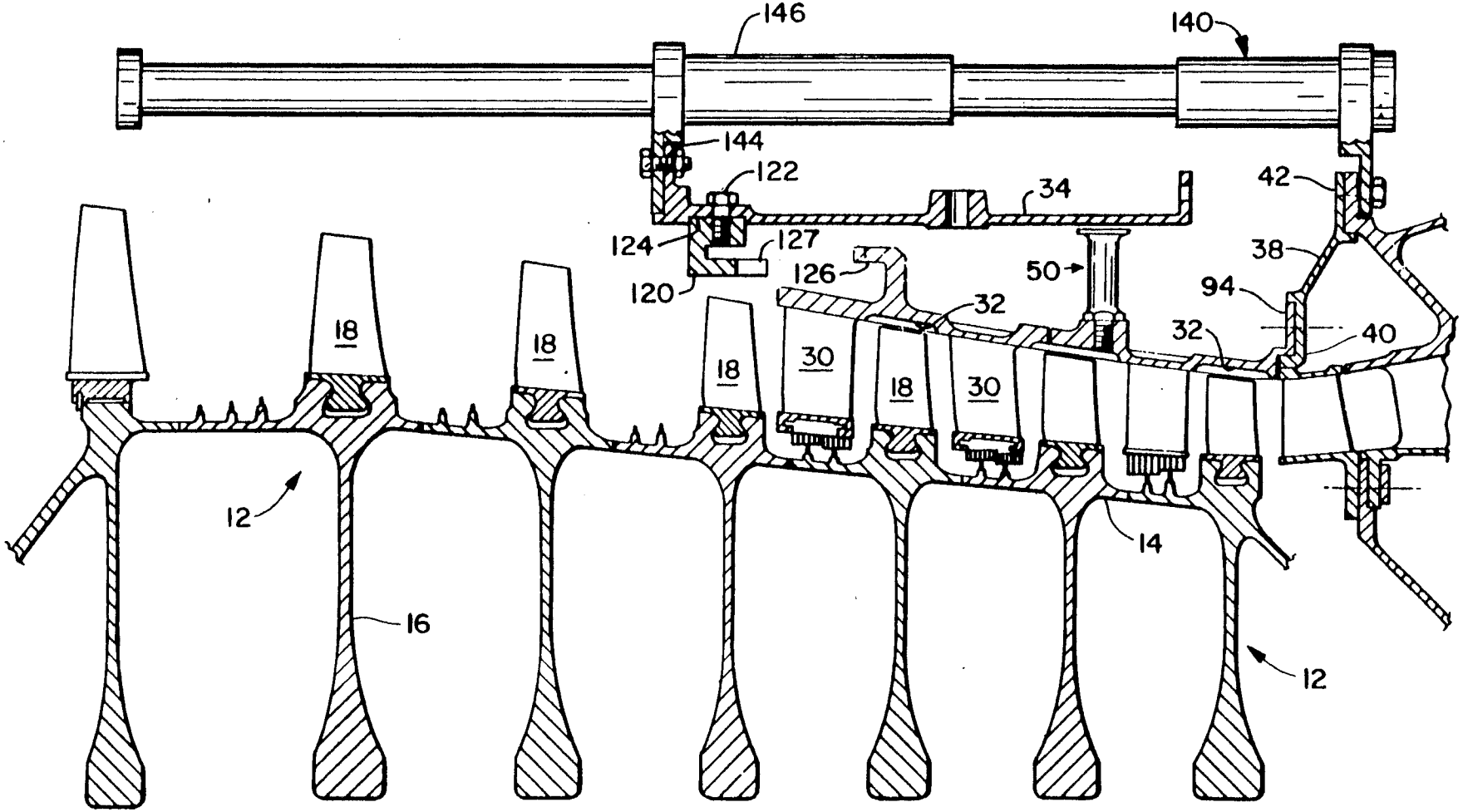
FIG. 5A is a view identical to FIG. 5A showing the assembly in another sequence.
Figure 5B:
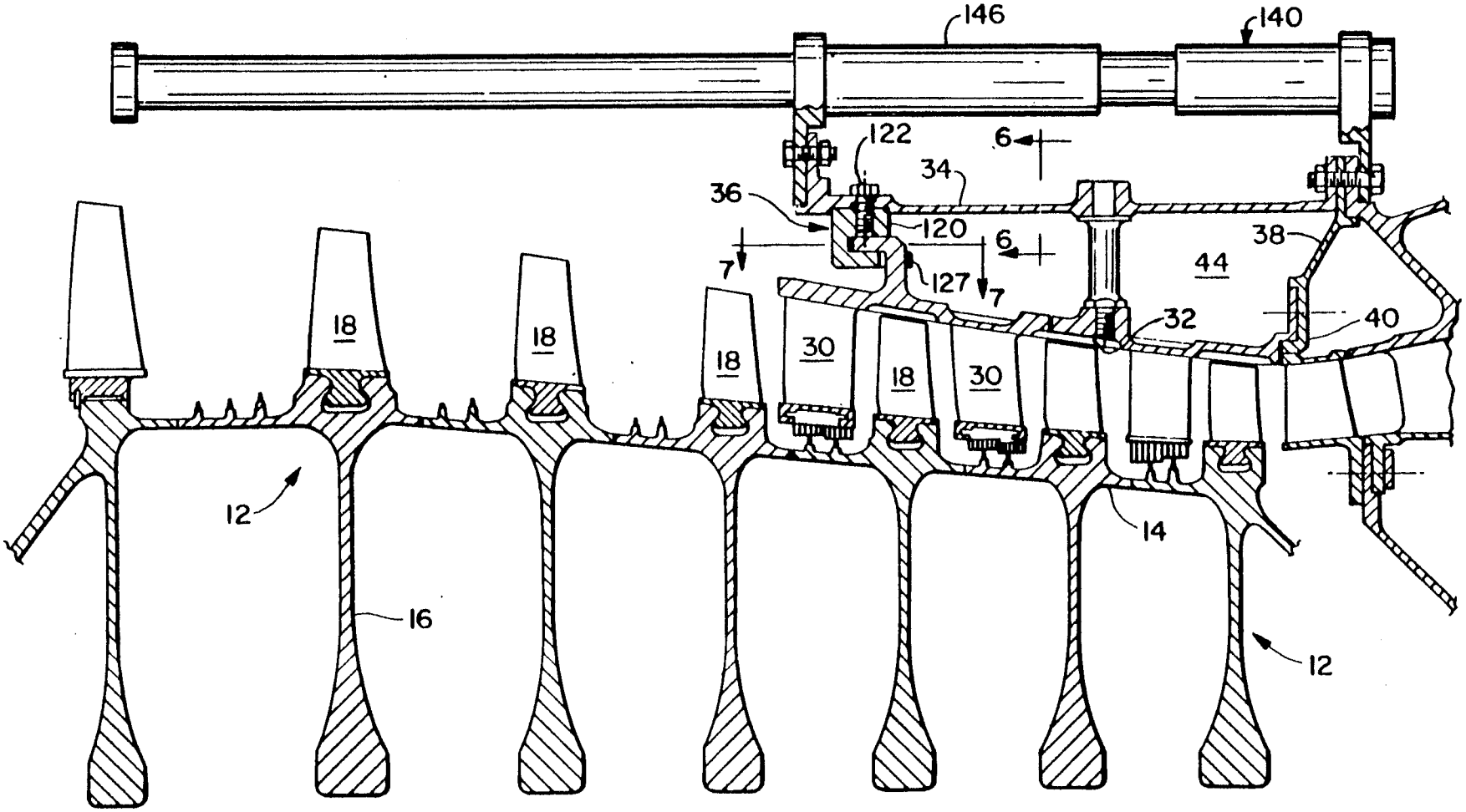
FIG. 5B is another view identical to FIG. 5 and 5A showing the attachment of the outer case to the stator vanes in the final sequence.
Figure 6:
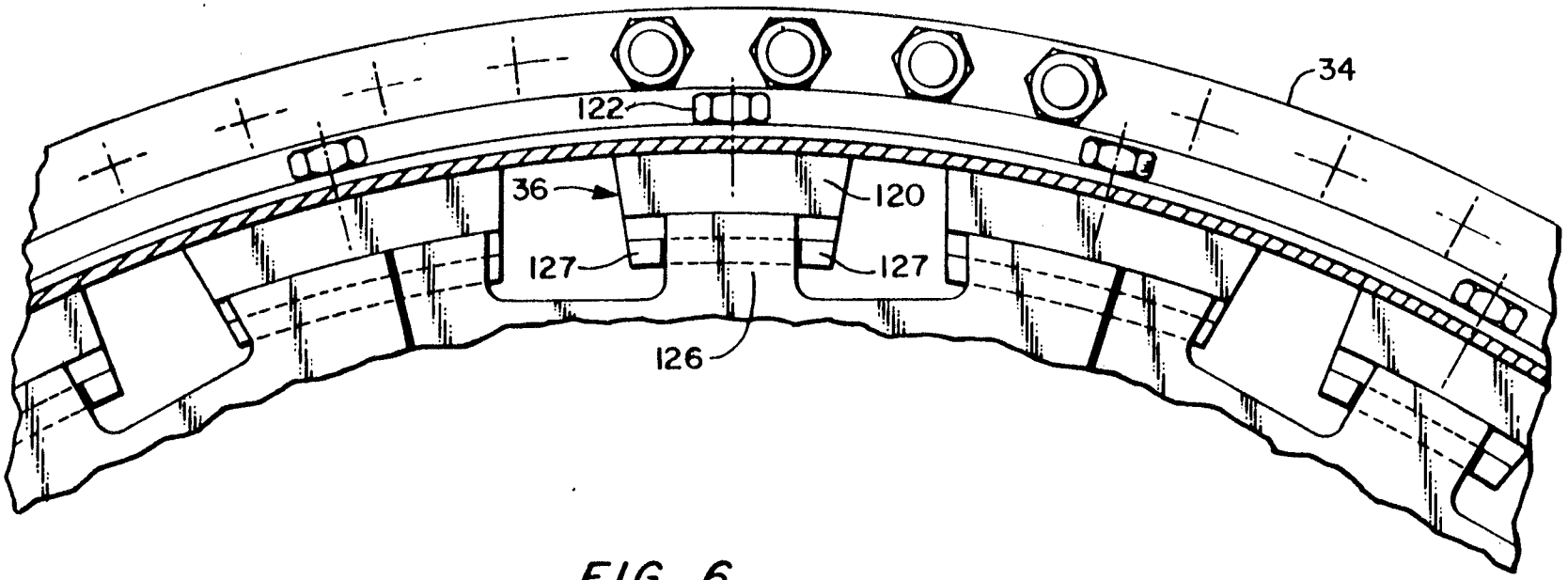
FIG. 6 is a partial view in elevation taken along lines 6—6 of FIG. 5B.

As can best be seen by FIG. 5, the full hoop case 34 is retained by one or more mounting fixture 140 (one being shown) which is fixed on one end to the engine's flange 42. The fore flange 144 is affixed to the complimentary flange extending from the sliding tube 146. At an intermediate axial position the support segment 120 is bolted to the case 34 as shown in FIG. 5A. The case 34 is then moved axially to align the aft flanges and the spool/nut 62 (see FIG. 5B), whereupon, the fixture 140 is removed and the bolts are tightened to the requisite torque level. The removal of the case, obviously, undergoes the reverse procedures.

Although the invention has been shown and described with respect to detailed embodiments thereof, it will be understood by those skilled in the art that various changes in form and detail thereof may be made without departing from the spirit and scope of the claimed invention.

I claim:

1. For a gas turbine engine having a compressor section comprising a plurality of compressor stages, the compressor stages having a plurality of axially spaced rows of compressor blades being rotably supported to a drum rotor, axially spaced annular compressor outer cases surrounding said drum rotor, the forwarded mounted compressor case being axially split and the aft mounted compressor case being a unitary full hoop, stator vanes concentric to said annular compressor outer cases having a plurality of axially spaced rows of vanes disposed adjacent said compressor blades and having shroud means defining an inner case being radially spaced from said annular mounted compressor outer cases, means for supporting said stator vanes to said full hoop compressor outer case comprising a plurality of hook-like elements extending radially outwardly from said inner case defining a tongue-like member, a removable hook-like element defining a groove complementing said tongue-like member supported to the inner diameter of said full hoop outer case and forming a "tongue and groove" attachment and means for supporting said removable hook-like element to said outer case whereby said inner case is supported to said full hoop outer case and restrained radially while permitting axial displacement and circumferential thermal growth.

2. A gas turbine engine as claimed in claim 1 including at least one pair of bifurcated lugs extending from the end of said tongue-like member for tangentially restraining said stator vanes.

3. A gas turbine engine as claimed in claim 2 wherein said stator vanes comprise a plurality of arcuate shaped segments mounted end-to-end defining a full hoop.

4. A gas turbine engine as claimed in claim 3 wherein said means for supporting said removable hook-like element is a bolt extending through said full hoop outer case and threadably engaging said tongue-like member.

5. A gas turbine engine as claimed in claim 4 wherein said tongue-like member fits into a recess formed on the inner diameter of said full hoop outer case.

* * * * *

UNITED STATES PATENT AND TRADEMARK OFFICE

CERTIFICATE OF CORRECTION

PATENT NO. : 5,127,797

DATED : July 7, 1992

INVENTOR(S) : Kenneth E. Carman

It is certified that error appears in the above-identified patent and that said Letters Patent is hereby corrected as shown below:

Col. 3, line 29, "identical to FIG 5A" should read --identical to FIG 5--.

Col. 4, line 46, "52" should read --72--.

Signed and Sealed this

Fourteenth Day of September, 1993

Bruce Lehman

*Attest:*

BRUCE LEHMAN

*Attesting Officer*

*Commissioner of Patents and Trademarks*